United States Patent [19]

Nagashima

[11] Patent Number: 4,815,872

[45] Date of Patent: Mar. 28, 1989

[54] METHOD, APPARATUS AND THERMAL PRINT RIBBON TO PROVIDE A PROTECTIVE LAYER OVER THERMALLY-PRINTED AREAS ON A RECORD MEDIUM

[75] Inventor: Masayoshi Nagashima, Kanagawa, Japan

[73] Assignee: Kabushiki Kaisha Toshiba, Kawasaki, Japan

[21] Appl. No.: 114,712

[22] Filed: Oct. 30, 1987

Related U.S. Application Data

[62] Division of Ser. No. 762,834, Aug. 6, 1985, Pat. No. 4,738,555.

[30] Foreign Application Priority Data

Aug. 20, 1984 [JP] Japan ..... 59-173559

[51] Int. Cl.[4] ..... B41J 3/20

[52] U.S. Cl. ..... 400/120; 400/240; 400/697; 346/76 PH; 219/216; 427/141

[58] Field of Search ..... 400/120, 191, 237, 240, 400/240.1, 240.2, 241.4, 697, 240.3, 240.4, 696; 346/76 PH; 219/216; 427/141

[56] References Cited

U.S. PATENT DOCUMENTS

| | | | |
|---|---|---|---|
| 3,942,621 | 3/1976 | Karlan | 400/697 |
| 4,113,392 | 9/1979 | Ploeger, jr. | 400/697 X |
| 4,472,479 | 9/1984 | Hayes et al. | 400/241.4 X |
| 4,704,615 | 11/1987 | Tanaka | 346/76 PH |

FOREIGN PATENT DOCUMENTS

| | | | |
|---|---|---|---|
| 1261734 | 2/1968 | Fed. Rep. of Germany | 400/241.4 |
| 2555236 | 6/1977 | Fed. Rep. of Germany | 400/696 |
| 72869 | 1/1984 | Japan | 400/241.4 |
| 7610227 | 3/1978 | Netherlands | 400/237 |

*Primary Examiner*—Edgar S. Burr
*Assistant Examiner*—James R. McDaniel
*Attorney, Agent, or Firm*—Cushman, Darby & Cushman

[57] ABSTRACT

Method and apparatus for the thermal transfer printing upon a record medium utilizing a print ribbon so as to form a protective transparent layer over a printed area upon a record medium. The thermal transfer print film includes plural colored ink regions separated by transparent ink regions. The method and apparatus of the present invention thus provide for the initial printing via thermal transfer of the colored ink regions onto an area of the record medium. Subsequent alignment of a region of the transparent ink with the printed area on the record medium and selective operation of thermal print heads thus thermally transfers portions of the thermal transparent ink to the previously colored ink printed area to provide a transparent ink layer over the printed information upon the record medium thereby protecting the same. The transparent ink layer thus serves to protect the colored ink printed information from abrasive rubbing and the like during processing and/or handling thereby preventing degradation of the print quality.

2 Claims, 7 Drawing Sheets

METHOD, APPARATUS AND THERMAL PRINT RIBBON TO PROVIDE A PROTECTIVE LAYER OVER THERMALLY-PRINTED AREAS ON A RECORD MEDIUM

This is a divisional of Ser. No. 762,834, filed Aug. 6, 1985 which was issued on Apr. 19, 1988 and is now U.S. Pat No. 4,738,555.

FIELD OF THE INVENTION

The present invention relates to a method and apparatus utilizing a thermal print ribbon so as to provide a protective layer over previously thermally-printed areas on a record medium, such as a sheet of paper or the like. More particularly, the present invention relates to the use of a thermal print ribbon which, in a preferred embodiment, includes plural discrete regions of a colored thermally-transferable ink which are separated by respective transparent protective ink regions. Accordingly, the present invention enables information to be printed upon areas of a record medium by the thermal transfer of portions of the colored visible ink from the ribbon and then to provide a protective layer over the thermally-transferred colored ink portions by subsequently thermally transferring portions of the transparent ink to the record medium. In such a manner, the present invention permits the transparent ink to be overlaid as a protective layer onto those areas of the record medium having previously been printed with the colored ink.

BACKGROUND AND SUMMARY OF THE INVENTION

Conventional thermal transfer printers typically supply a record medium, such as a paper sheet, together with a thermal transfer recording ribbon to a print section. When the record medium and the film are thus disposed at the print section, thermal print heads are then selectively driven in response to print information so that portions of the thermally transferable ink on the ribbon will be melted and thence transferred onto the record medium. As can be appreciated, during subsequent feeding and handling of the printed sheets, mechanical abrasion of the print areas will occur presenting a problem that the printed information upon the record medium will be smeared thereby deleteriously affecting the print quality. Also, mechanical abrasion during processing and/or the subsequent handling of printed material may cause the print quality to fade thereby deleteriously affecting the print resolution. As such, there exists a need to prevent degradation of the printed information upon a record medium and it is towards this need that the present invention is directed.

In accordance with the present invention, a thermal transfer printing ribbon is provided having a base film coated with a plurality of transfer printing ink regions which are spaced-apart from one another in the longitudinal direction of the ribbon—that is, the direction in which the ribbon will be fed to a print section in a thermal transfer apparatus. Each transfer printing ink region can be comprised of a single color or can be subdivided into selected regions of different colors so as to permit multi-colored inks to be transferred to the record medium. Interposed between the adjacent pairs of the colored print ink regions, there is provided a region of transparent protective ink which itself is also thermally transferable.

Accordingly, by conveyance of a record medium to a print section having plural selectively operable thermal print heads, the visible or colored print ink can be thermally transferred to selected portions of the record medium by the selective operation of the thermal print heads. The present invention then subsequently permits the thermal transfer of the protective transparent ink so that the transferred transparent ink is overlaid upon the transferred colored ink on the record medium. As such, the information printed upon the record medium by means of the transferred colored ink will be visible through the layer of transferred transparent ink superposed thereupon while, at the same time, the layer of transferred transparent ink will provide protective functions against mechanical abrasion thereby maintaining the print quality and print resolution of the record medium.

The above advantages of the present invention, as well as others, will become more clear to the reader after careful consideration is given to the detailed description of the presently preferred exemplary embodiments thereof which follow.

BRIEF DESCRIPTION OF THE ACCOMPANYING DRAWINGS

Reference will be hereinafter made to the accompanying drawings wherein like reference numerals throughout the various figures denote like structural elements and wherein.

Figure 5A:
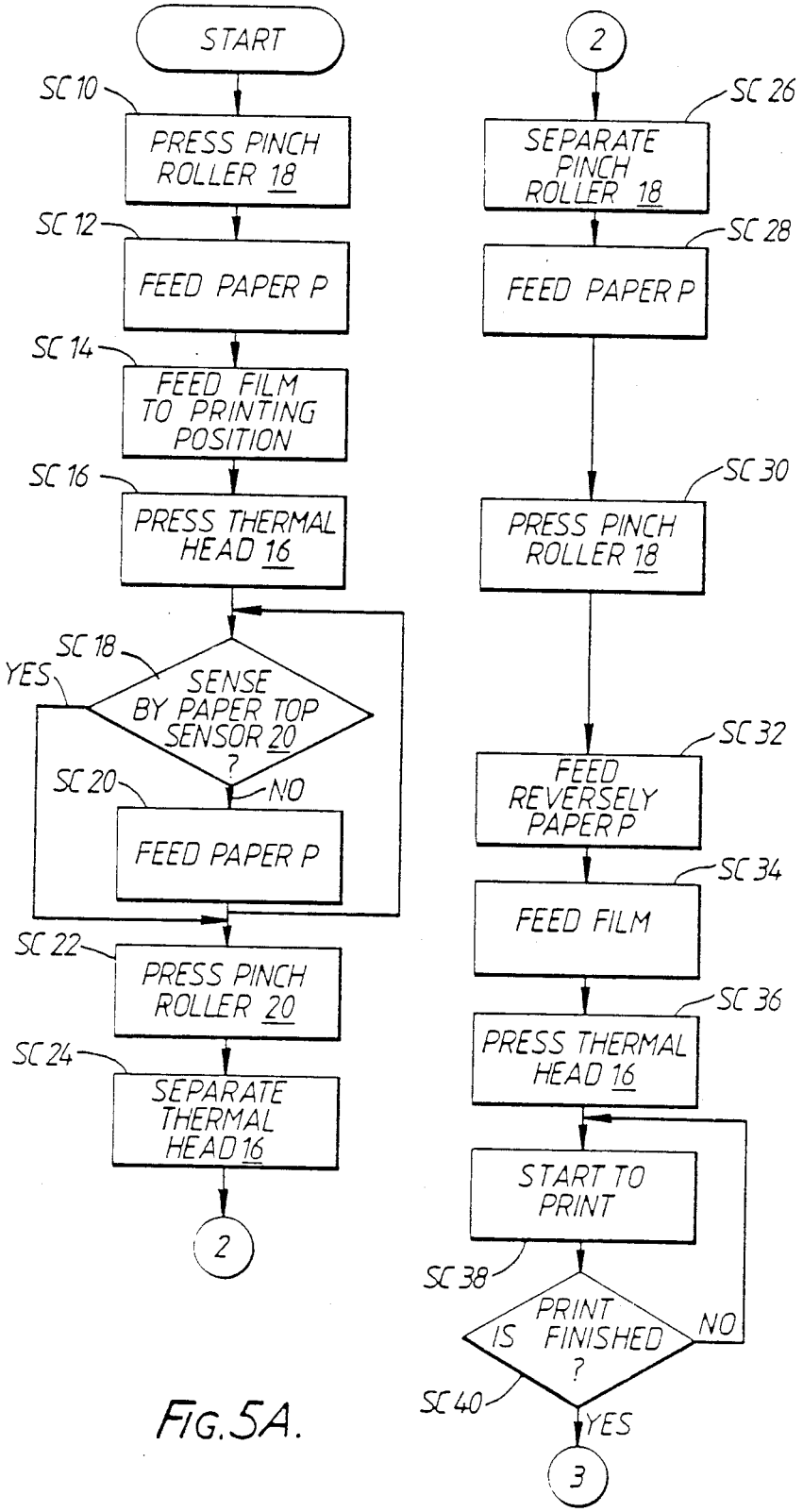
Figure 5B:
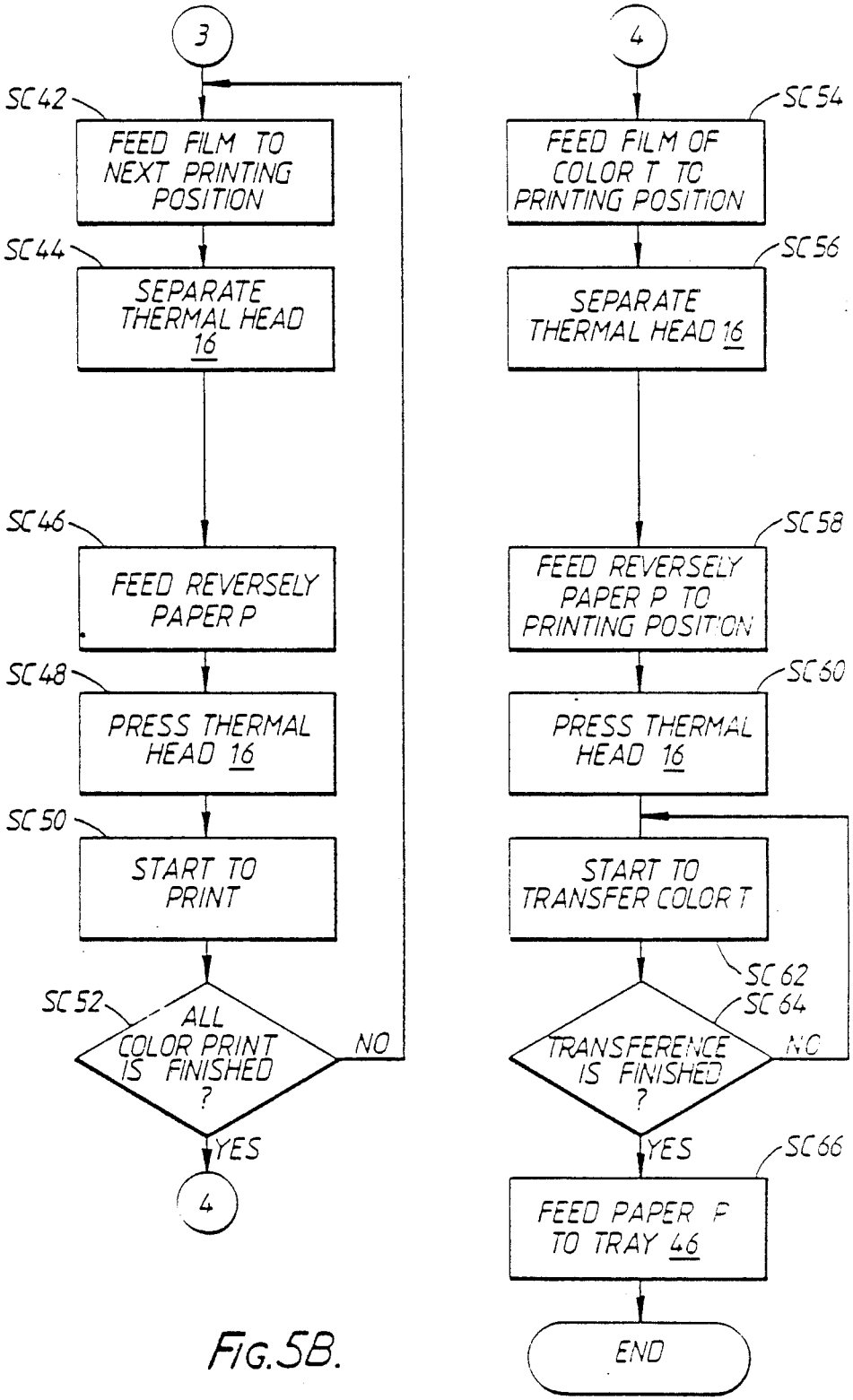
Figure 7:
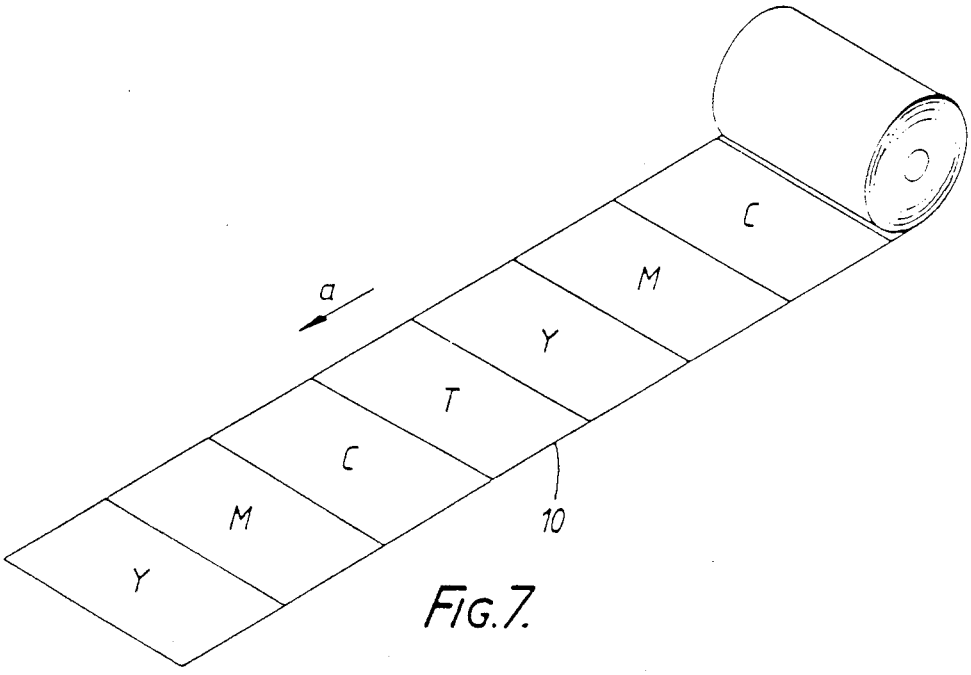
Figure 8:
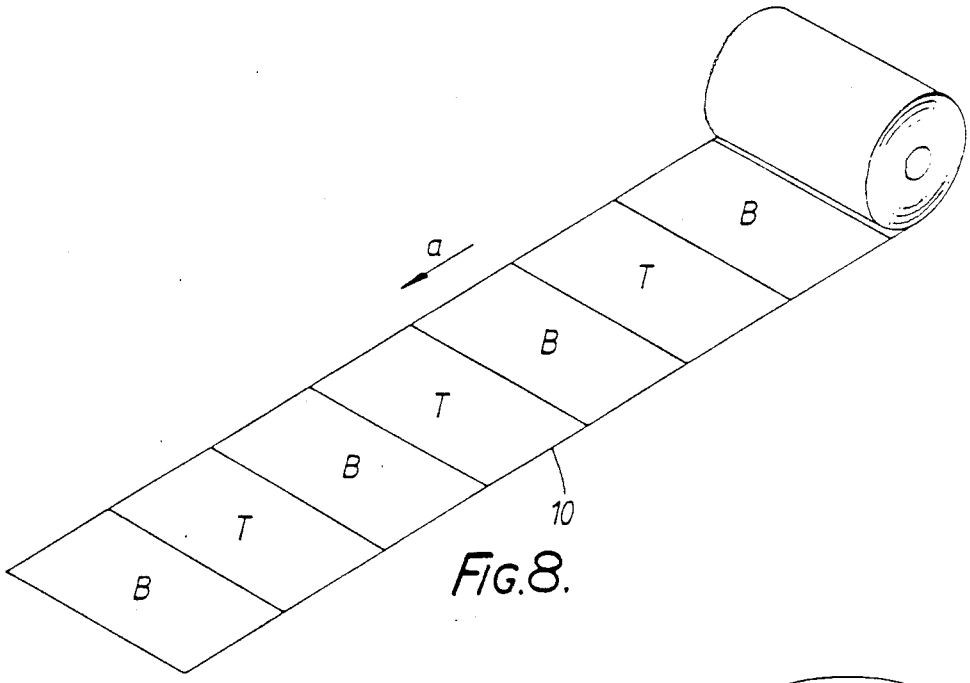
Figure 9:
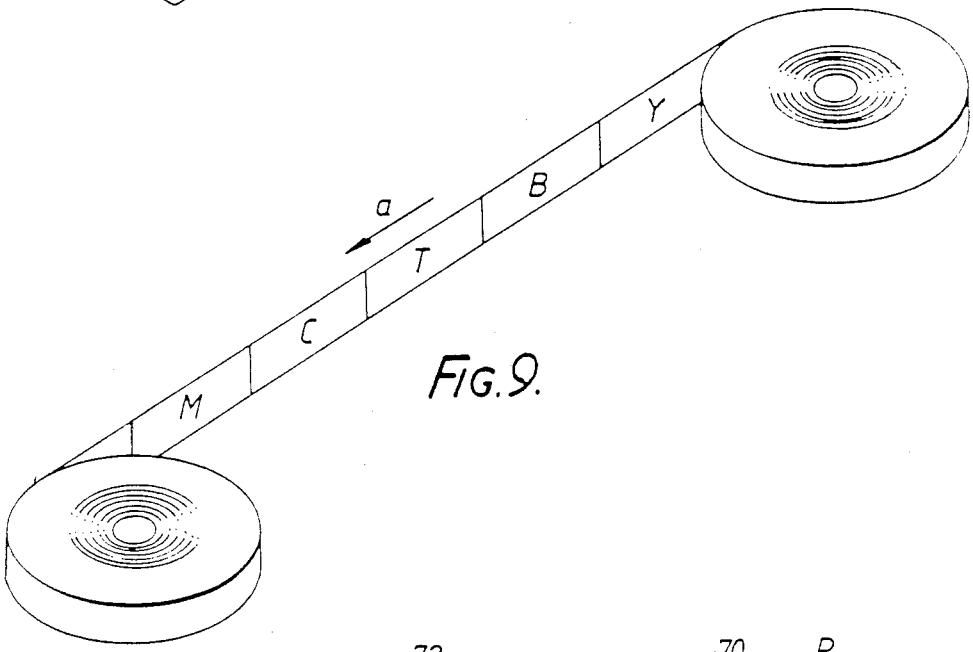
Figure 10:
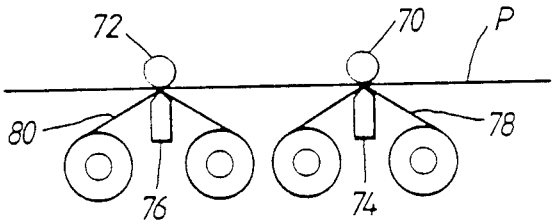

FIGS. 5A and 5B together represent a control flow chart for the printing operation of the thermal transfer apparatus of the present invention;

FIGS. 6A through 6F represent the sequential operation of the thermal printing apparatus of the present invention;

FIGS. 7 and 8 respectively depict another thermal transfer print ribbon of the present invention;

FIG. 9 is a perspective view showing a thermal transfer ribbon embodiment of the present invention particularly well suited for use in a serial printer; and FIG. 10 is a schematic view of another embodiment of the thermal transfer printing apparatus of this invention.

DETAILED DESCRIPTION OF THE PREFERRED EXEMPLARY EMBODIMENTS OF THE PRESENT INVENTION

Figure 1:
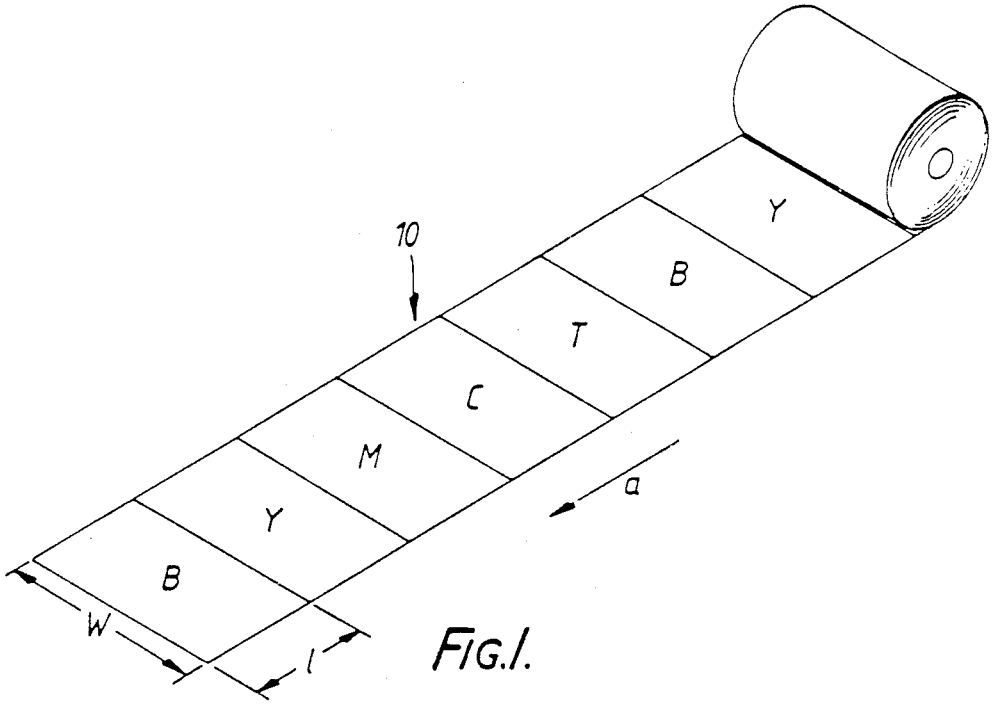
FIG. 1 is a perspective view of one embodiment of a thermal transfer print ribbon in accordance with the present invention.
Figure 2:
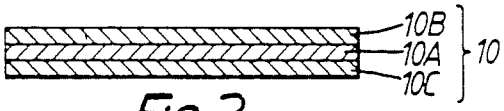
FIG. 2 is a cross-sectional elevational view of the print ribbon of FIG. 1.

A particularly preferred embodiment of the thermal transfer print ribbon 10 is shown in accompanying FIGS. 1 and 2. As can be seen, ribbon 10 is preferably wound in a roll form and includes a base film 10A of a plastics or capacitor paper material. One side of base film 10A is coated with an ink layer 10B while the other side preferably includes a heat-resistant coating layer 10C. As is well known, the recording ink of ink layer 10B is solid at normal ambient temperatures and is fluid or sublimating at elevated temperatures. Preferably, the recording ink layer 10B is an ink comprised of wax, resin and a color pigment. If the ink is of the sublimation type, it is preferable that it be comprised of a binder substance and a sublimating dye. As shown in FIGURE 1, ink of ink layer 10B is colored (i.e. visible) and is formed of a plurality of multi-color ink regions along its lengthwise direction (that is, the feed direction as indicated by arrow A in FIGURE 1). Each region, for example, includes black ink (B), yellow ink (Y), magenta ink (M), and cyan ink (C) in that order coated on base film 10A.

In accordance with the present invention, each region of visible or colored ink on film 10 is separated in the lengthwise feeding direction of film 10 (i.e. arrow a) by transparent ink regions T which are also coated upon the base film 10A. Transparent ink regions T preferably are comprised of wax, vinyl chloride, vinyl acetate, acrylic resin, styrene or epoxy. A non-adhesive material or a slip additive such as silicone or talc may be added to the transparent ink regions T as required.

Figure 3:
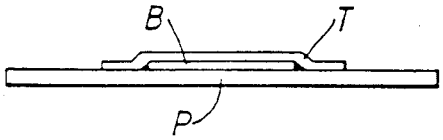
FIG. 3 is a cross-sectional elevational view showing a record medium having transferred portions of colored ink and transparent ink thereon in a greatly enlarged manner for clarity of presentation.

As briefly described, thermal transfer ribbon 10 preferably utilizes four-color print ink regions as is conventional in the multi-color thermal transfer print art. However, in accordance with the present invention, each four-colored print ink region is separated by a transparent ink region T. Each transparent ink region T is associated with a respective four-color print ink region downstream from the latter relative to the feed direction (arrow a) of the ribbon. Thus, the print ribbon of the present invention is formed of a plurality of print regions each print region thereby being preferably formed of five types of ink such as, black ink (B), yellow ink (Y), magenta ink (M), cyan ink (C) and transparent ink (T). Use of the thermal transfer ribbon 10 of the present invention enables portions of the transparent ink region T to be applied onto that area of the record medium which has been previously printed by the four-color recording ink as can be seen by reference to FIGURE 3. As a result, it is possible to transfer transparent ink T as an overlay upon a printed portion of record medium P so as to form a layer of the transparent ink T thereover. In such a manner, the transferred transparent ink T forms a protective layer over the printed colored ink (for example black ink (B) as shown in FIG. 3) so as to prevent degradation of the print quality by mechanical abrasion, rubbing and/or handling. In addition, the protective layer of transparent ink region T serves to prevent fading and thus prevents loss of print resolution over time. Handling and greater lubricity of the record medium P can be enhanced if the transparent ink coating T includes a non-adhesive compound or a lubricant compound.

Ribbon 10 shown in accompanying FIG. 1 is preferably used for a line-type thermal transfer apparatus and the length l of the colored ink regions correspond to the maximum printing area of the record medium. The width w of the color ink area is however preferably greater than the maximum printing width of the record medium.

Figure 4:
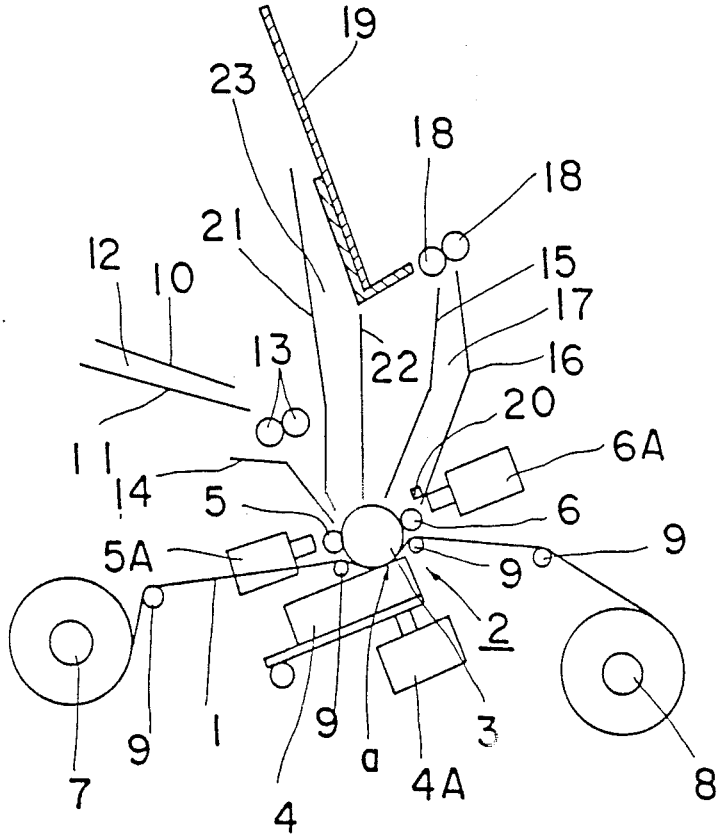
FIG. 4 is a schematic view of a thermal transfer printing apparatus of the present invention.

FIG. 4 shows the construction of a thermal transfer print apparatus of the present invention which utilizes the above-described thermal transfer print film 10. The thermal transfer apparatus shown in accompanying FIG. 3 includes a transfer portion 12 having a platen roller 14 and a thermal head 16 positioned so as to be in opposing relationship relative to the platen roller 14. Thermal transfer ribbon 10 and a record medium P are thus disposed between the platen roller 14 and the thermal head 16 when printing is effected. Thermal head 16 is preferably a so-called line printer type thermal head in which heat elements (not shown) are formed in line dots along the axial direction of platen roller 14, (i.e. transverse to the conveyance of record medium P).

Record medium P is fed to the print section A by means of paper feed pinch rollers 18 and paper discharge pinch rollers 20. Pinch rollers 18 and 20 can be placed in contact with the outer circumference of platen roller 14 or spaced-apart therefrom by means of solenoids 18A and 20A, respectively. Print head 16 is also provided with a solenoid 16A so as to pivotally move the thermal head 16 about its supporting bracket 16B to thereby move thermal head 16 between a print position wherein the print head sandwiches the print ribbon 10 and record medium P between the platen roller 14 and the print head 16 and a non-print position wherein print head 16 is spaced from platen roller 14. The thermal transfer ribbon 10 is preferably provided in a roll form so that feed roll and discharge rolls 22A, 22B are respectively placed upon spindles 22, 24. The ribbon 10 is thus disposed between rolls 22A, 22B and is guided via guide rolls 26.

The record medium P is conveyed along conveyance path 32 defined between guide plates 28 and 30. A pair of aligning rollers 34 are positioned downstream of guide plates 28, 30 so as to correctly align the record medium P and deliver it to the print section A at the proper time sequence. The record medium fed by aligning rollers 34 is then conveyed to the print section 12 via guide path 35 which is established between guide plate 36 and guide 50. The discharge guide path 42 is positioned downstream of platen roller 14 so as to accept the discharged record medium P therefrom. Discharge path 42 is defined between guide plates 38 and 40 and extends upwardly from platen roller 14 and discharge pinch roller 20. A pair of discharge feed rollers 44A, 44B and a discharge tray 46 are disposed downstream of the discharge guide path 42 so as to transfer printed record medium P from the guide path 42 and into the tray 46 to permit accumulation thereof.

A position sensor 48 is located on the downstream side of platen roller 14 in the discharge path 42 for the purpose of detecting the forwardmost portion of the record medium P when the latter is fed to the print section 12. A return guide path 54 is defined between guide plates 50 and 52 so as to permit the return of the record medium P upon reversing the rotational movement of platen roller 14 (i.e. from a counterclockwise to a clockwise rotation direction as viewed in FIG. 3) for the purpose of transferring recording ink of a different color onto the same print material as will be described in more detail below.

Figure 6A:
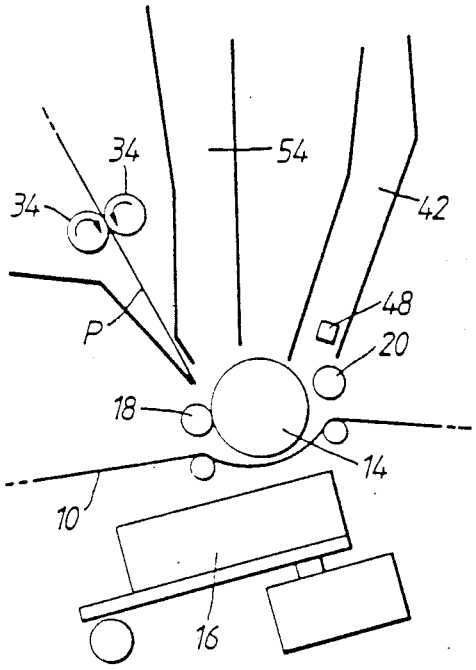
Figure 6B:
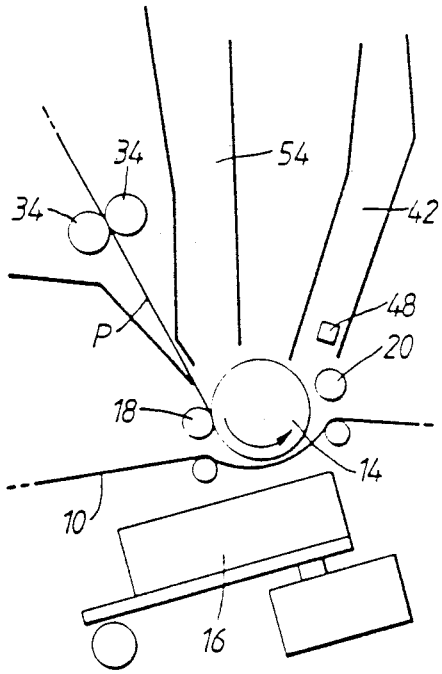

The operation of the apparatus of the present invention will now be described below with particular reference being directed to accompanying FIGS. 5A–5B and 6A–6F. When a start signal is supplied from an external control panel (not shown), paper feed pinch roller 18 is pressed against platen roller 14 at step SC10. At step SC12, aligning roller 34 and platen roller 14 are driven to feed paper P or the print material as illustrated in FIGS. 6A and 6B. At the same time or at step SC14, film take-up 24 is driven to feed a particular ink color, for example, black ink B, to the printing position a. Simultaneously with film feeding, at step SC16, thermal head 16 is pressed against platen roller 14 by actuation of solenoid 16A. Paper top sensor 48 then judges at step SC18 whether or not the top of paper P has been sensed.

Figure 6C:
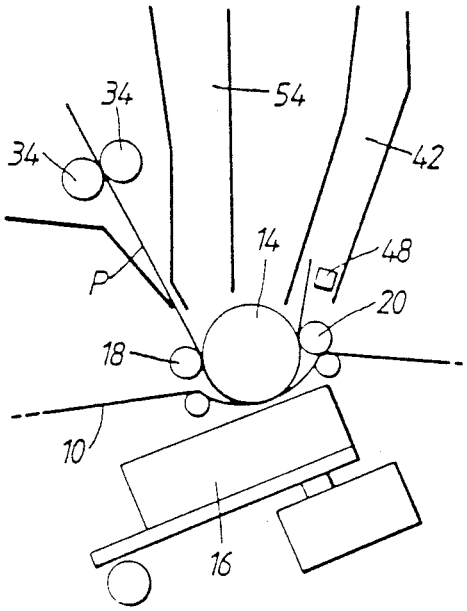

If the top of paper has not been sensed, steps SC20 and SC18 are repeated to feed paper P. When the top of paper is detected by the sensor 48 as shown in FIG. 6C, discharge pinch roller 20 is pressed against platen roller 14 at step SC22 by actuation of solenoid 20A and thermal head 16 is separated from platen roller 14 at step SC24 while pinch roller 18 is separated at step SC26. Paper P is then slightly moved at step SC28 by the counterrotation (i.e. clockwise rotation as viewed in FIG. 6) of platen roller 14 to remove slack rom paper P. At step SC30, paper feed pinch roller 18 is again pressed against platen roller 14 while at step SC32, the platen roller 14 is reversed so as to reversely feed paper P a slight amount. At this time, paper P is tautly positioned between feed and discharge pinch rollers 18 and 20 around a portion of platen roller 14 thereby establishing a print start position.

Figure 6D:
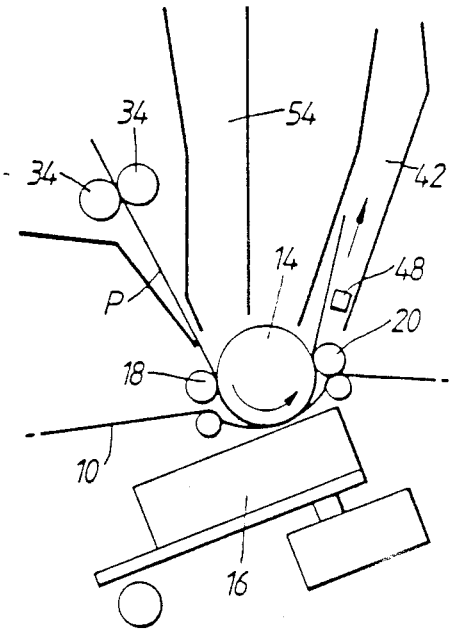
Figure 6E:
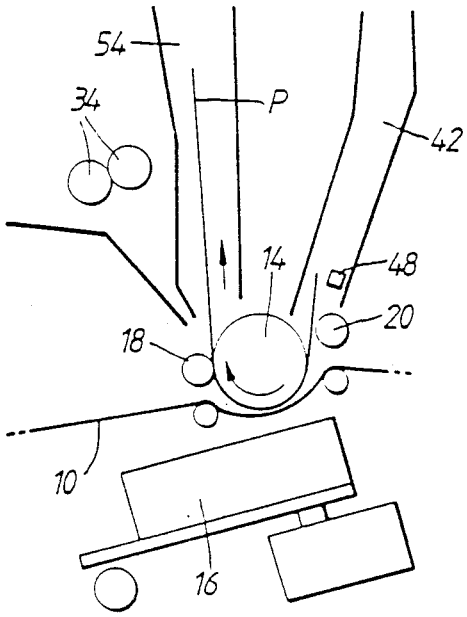
Figure 6F:
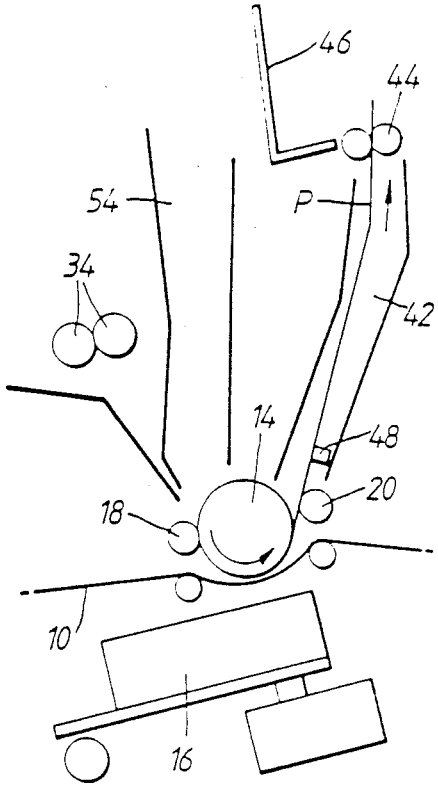

After the print start position of paper P has thus been determined, both the thermal transfer film and the paper P are fed at step SC34 and the thermal head 16 is then pressed against platen roller 14 at step SC36. Printing starts at step SC38 as is shown in FIG. 6D. Steps SC38 and SC40 are repeated until the end of a print—that is until a page sync signal or a stop signal is detected at step SC40. When the end of print is detected, the thermal transfer film 10 is fed by step 42 to the next printing position of, for example, yellow (Y). Thermal head 16 is separated from platen roller 14 at step SC44 while at step SC46, paper P is reversely fed to the print start position as shown in FIG. 6E. Paper P is then at least partially housed in return guide path 54. At step SC48, thermal head 16 is again pressed against the platen roller 14 so that printing of the next color (i.e. yellow in this example) can commence at step SC50.

At step SC52, whether or not printing of all colors specified by the color designation signal have been completed is judged. If printing of all colors is not complete, steps SC42 through SC52 are repeated. When all of the colors black (B), yellow (Y), magenta (M) and cyan (C) have been printed, film take-up 24 is driven and transparent ink region T of ribbon 10 is fed to the printing position A at step SC52. Thermal head 16 is separated from the platen roller 14 at step SC56, while at step SC58, paper P is reversely fed to the printing position A. At step SC60, transferring transparent ink T begins. Driving of thermal head 16 at this time is somewhat different from the aforegoing driving operation for transfer of each color (i.e., selective driving based on pattern signals supplied from external equipment). Thus, thermal head 16 operates such that the portion where at least black (B), yellow (Y), magenta (M) or cyan (C) is transferred is covered to form a protective layer of transparent ink T over the transferred color ink.

When transferring of transparent ink T is complete, the pair of paper discharge rollers pair 44A, 44B are driven at step SC66 to feed paper P to tray 46 thus completing the transfer operation. With the thermal transfer apparatus, as mentioned, it is possible to transfer transparent ink T onto one set of recording ink (for this embodiment, one set consisting of four colors) immediately after transfer of the latter. In addition, if thermal transfer film 10 is employed with the apparatus, it is fed in sequence to paper P for repeated transfer operation. Therefore, the information transferred to each paper P can be protected by transparent T ink layer and, at the same time, fading of ink with time can be prevented.

The present invention is not limited to the aforementioned embodiment but can also be applied to various purposes within the scope of the appended claims. For example, any ink used as transparent ink T is sufficient if it has such a degree of transparency as to enable visual recognition of images formed by the transfer of any other colored recording ink. Also, one set of recording ink utilized in addition to, the above-mentioned four color combination. Thus, the colored ink regions of ribbon 10 may be a combination of three colors, for example, yellow (Y), magenta (M) and cyan (C) as shown in FIG. 7 or a single color, for example, black (B) as shown in FIG. 8. The same effect as stated can be obtained by forming a coat of transparent color T on the coat of each set of colors. If sublimating recording ink is used, no practical problem will occur by adding sublimation-inhibitives to transparent color T ink.

Thermal transfer film 10 as shown in FIG. 1 is an example of a film usable with a line printer. For a film to be used with a serial printer, recording ink is to be applied onto a strip film along the transfer direction shown in FIG. 9. Thus, the thermal transfer apparatus can also be advantageously utilized in both line and serial printers.

FIG. 10 shows another means of forming a protective layer of transparent ink. In FIG. 10, thermal heads 74 and 76 are provided on the feed path of paper P in such a manner that they can contact and be separated from platen rollers 70 and 72. Thermal transfer film 10, having plural colored ink regions consisting of, for example, four colors, e.g., black (B), yellow (Y), magenta (M) and cyan (C), is positioned between first thermal head 74 and first platen roller 70. On the other hand, thermal transfer ribbon 80 provided only with transparent color T and is positioned between second thermal head 76 and second platen roller 72. With such a configuration, printing of each color can be implemented by driving first thermal head 74, and formation of a protective layer of transparent ink by driving second thermal head 76.

Although only several preferred embodiments have been described in detail above, those skilled in the art will readily appreciate that many modifications are possible in the preferred embodiments without materially departing from the novel techniques and advantages of this invention. Accordingly, all such modifications are intended to be covered by this invention and shall be accorded the broadest scope of the following claims.

What is claimed is:

1. A method for the thermal transfer printing upon a record medium comprising the steps of:

(a) conveying a record medium in one direction along a feed path to a print section having plural selectively operable thermal print heads;

(b) thermally transferring a visible printing ink to a selected portion of said record medium by selectively operating said thermal print heads; and then subsequently (c) thermally transferring a protective transparent ink to said printed selected portion of said record medium wherein said transferred transparent ink is overlaid upon said transferred visible printing ink upon said record medium to protect the transferred visible printing ink, steps (b) and (c) being practiced utilizing a transfer printing medium having a base film and plural discrete regions of said visible printing ink deposed on said base film, said visible ink regions being separated by respective regions of said transparent ink.

2. A method for the transfer printing onto a record medium utilizing a thermal transfer film having plural visible transfer ink regions separated by thermally-transferable transparent protective ink regions comprising the steps of conveying the record medium to a thermal printing section having plural print heads, aligning a predetermined one of said visible ink regions with an area of said record medium to be printed, thermally activating selected ones of said print heads to cause the thermal transfer of portions of said visible ink to said record medium area, and then subsequently aligning said transparent ink region with said printed area of said record medium and again selectively energizing said print heads to cause thermal transfer of said transparent ink region to form a protective layer over said printed area of said record medium.

* * * * *